US005202045A

United States Patent [19]

Karpusiewicz et al.

[11] Patent Number: 5,202,045

[45] Date of Patent: Apr. 13, 1993

[54] S-SHAPED DETERGENT LAMINATE

[75] Inventors: William M. Karpusiewicz, Floral Park; Jesse J. Kiefer, Valley Cottage, both of N.Y.; Martin N. Dunckley, Bedford, England

[73] Assignee: Lever Brothers Company, Division of Conopco, Inc., New York, N.Y.

[21] Appl. No.: 293,721

[22] Filed: Jan. 5, 1989

[51] Int. Cl.[5] ..... C11D 17/00; B65D 73/00; B65D 90/04; B05D 3/12

[52] U.S. Cl. ..... 252/90; 252/92; 252/93; 206/484; 206/494; 220/416; 220/417; 220/453; 220/DIG. 5; 220/DIG. 13; 427/242

[58] Field of Search ..... 427/242; 252/90, 92, 252/93; 206/484, 494; 220/DIG. 5, DIG. 13, 416, 417, 453

[56] References Cited

U.S. PATENT DOCUMENTS

| | | | |
|---|---|---|---|
| 2,665,528 | 1/1954 | Sternfield et al. | 51/185 |
| 3,308,067 | 3/1967 | Diehl | 252/550 |
| 4,170,565 | 10/1979 | Flesher et al. | 252/93 |
| 4,170,678 | 10/1979 | Urfer et al. | 428/124 |
| 4,348,293 | 9/1982 | Clarke et al. | 252/90 |
| 4,356,009 | 10/1982 | Davies et al. | 252/90 |
| 4,515,703 | 5/1985 | Haq | 252/92 |
| 4,733,774 | 3/1988 | Ping, III et al. | 206/0.5 |

*Primary Examiner*—Paul Lieberman
*Assistant Examiner*—William S. Parks
*Attorney, Agent, or Firm*—Milton L. Honig

[57] ABSTRACT

An article for delivering a cleaning composition to a wash water, preferably for laundering clothes, is formed from a flexible substrate folded into an S-shaped construction. Within one region of the folded substrate is positioned a detergent composition that includes a surfactant and builder in the form of a paste having adhesive strength sufficient to bind the two surrounding substrate areas together. In a second region of the folded substrate separate from that occupied by the detergent composition, there is a further composition, adhesive in nature, containing a component which may be a bleach, bleach precursor, enzyme and/or fabric softener. No other bonding is present between the three substrate area flaps constituting the S-shaped construction. The compositions between the substrate areas are easily released to the wash water when the article is placed therein.

15 Claims, 1 Drawing Sheet

FIG.
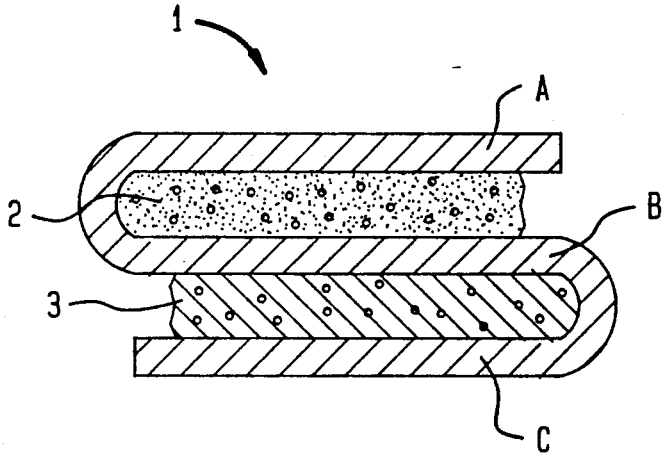

S-SHAPED DETERGENT LAMINATE

BACKGROUND OF THE INVENTION

1. Field of the Invention

The invention relates to a detergent sheet of laminate construction useful for the washing of fabrics.

2. The Prior Art

Heavy duty detergent products for laundering of fabrics conventionally have been sold in the form of powders and liquids. Consumers have been required to measure appropriate dosages from containers holding these products. This measuring process sometimes leads to accidental spillage, often is inaccurate, and can generally be described as messy or inconvenient.

Therefore, the industry has sought to overcome these problems by use of a single article containing premeasured amounts of detergent plus other functional cleaning aids within a single package. Two approaches have been taken to providing a single dosage article, namely pouches and impregnated sheets.

Pouches filled with powdered detergents are now presently on the market. These products have some inherent delivery problems. Transfer of the powder actives through the pouch walls is not always sufficiently fast. There are also limits to the amount of product that can be dosed per pouch. By virtue of its construction, the pouch is also bulky and rather large.

Impregnated sheets, on the other hand, have the advantage of being thin. There is also a larger surface area from which the actives can be delivered. This allows greater dissolution rates than available with a pouch. There is no longer a problem of substrate porosity being a limiting factor of construction as in the pouch. Too large a porosity in a pouch will allow powdered product to sieve through during handling. By contrast, sheet articles operate better with large porosity substrates because higher loadings can be achieved. Pouch products also contain trapped air which during the laundry process causes the pouch to float on top of the water surface. This reduces the propensity for contents to dissolve and thereby also delays dosing. Sheets do not suffer from this disadvantage.

There are, however, two significant problems with impregnated single sheets. First, the impregnate detergent formulation must not be overly sticky but rather substantially solid at room temperature. Consumers dislike sheets that feel tacky, wet or greasy. Likewise, the impregnated sheet must have a certain degree of flexibility for ease of use and aesthetic appeal. A boardy hand would not be acceptable. Another disadvantage is the limitation upon amount of the formulation capable of being impregnated into a single sheet. Active detergent loading normally is severely limited by the absorptive capacity of a substrate.

An alternative to the single sheet is a several sheet laminate construction. Lamination sandwiches the detergent formulation between a pair of substrates. This construction avoids the problem with tacky or wet feel and can also achieve higher loadings than the single sheet vehicle. A further advantage is that active systems with up to 30% water can be utilized. This effectively eliminates any need for drying the products.

There are a number of laminated sheet articles reported by the art. U.S. Pat. No. 2,665,528 (Sternfield et al.) discloses a disposable cleaning tissue wherein an adhesive abrasive cleansing mixture is placed between two fibrous substrates. The tissue is intended for re-usable application in cleaning hard surfaces wherein the abrasive mixture slowly released over time. A disadvantage with this construction is that upon complete leaching of the adhesive cleansing medium, the article separates into a pair of substrates which aesthetically detracts from the product.

U.S. Pat. No. 4,170,678 (Urfer et al.) also reports a multiple use article. A layer of fabric softening chemicals is coated both as an outermost and innermost layer of a folded multi-layered flexible substrate. Initially, only the outer coating of fabric conditioner is released to the clothes being tumbled in a clothes dryer. After the first use, the folded article is peeled apart at a loosely-bonded end thereby exposing additional fabric conditioner coated on the inner surface of the article. Similar to impregnated single sheets, this system also features the undesirable aspect of a potentially tacky outer coating. The innermost coating of active material is inhibited from release by attachment of the "free" ends of the folded sheet.

U.S. Pat. No. 4,515,703 (Haq) discloses an article for wiping surfaces comprising two substrate layers bonded together in such a way as to create a plurality of compartments. Within these compartments may be lodged a treating chemical including soap, detergent or bleach. Although this system is described in terms of a laminate construction, in actuality the wiping article is a series of adjoining pouches with all the attendant problems for laundering purposes.

Accordingly, it is an object of this invention to provide a cleaning article in flexible substrate form which when being handled avoids a wet, greasy or tacky feel.

Another object of this invention is to provide a cleaning article which has the capacity to carry a relatively large loading of detergent active material.

Another object of this invention is to provide a cleaning article capable of carrying more than one distinct cleaning composition in physically separate regions of the article.

Still another object of this invention is to provide a cleaning article wherein mutually incompatible compositions of enzyme, bleach, fabric softener and/or detergent are held apart from one another within the article.

It is a further object of this invention to provide a cleaning article which has a substrate that separates into but a single substrate upon exhaustion of the detergent active material therefrom.

It is a still further object of this invention to provide a cleaning article which is simple in its manufacture and convenient to store.

It is an even further object of this invention to provide an effective, convenient product for cleaning clothes in an automatic washing machine.

SUMMARY OF THE INVENTION

An article for delivering a cleaning composition to a wash water is herein disclosed. This article comprises:

( i) a flexible substrate folded into a unitary S-shaped construction, said construction including three substrate areas each lying in substantially parallel planes one above another;

(ii) a detergent composition comprising an effective amount for cleaning fabrics of a surfactant and a builder, said composition being spread in a region between a first and second of said substrate area and having an adhesive strength sufficient to bind said first and second area together, and at least one edge length of said first area not being bonded, other than through said detergent composition, to an adjacent edge length of said second area and thereby allowing egress of said composition into said wash water; and (iii) a further composition for cleaning fabrics which is spread in a region between said second area and a third adjacent one of said substrate areas and having an adhesive strength sufficient to bind said second and third area together, and at least one edge length of said second area not being bonded, other than through said further composition, to an adjacent edge length of said third area and thereby allowing egress of said further composition into said wash water, said further composition comprising a component selected from the group consisting of bleaches, bleach precursors, enzymes, fabric softeners and mixtures thereof.

BRIEF DESCRIPTION OF THE DRAWING

The above objects, features and advantages of the present invention will become more readily apparent from the following description, reference being made to a single FIGURE representing a side view of one embodiment of the invention.

DETAILED DESCRIPTION OF THE INVENTION

A cleaning article is herein described which overcomes many of the problems associated with known types of flexible substrate vehicles. Specifically, the present invention envisages a flexible sheet 1 that has been alternately folded along a pair of lines parallel to an edge of the sheet, preferably each at a distance one-third from each edge. In other words, the sheet is folded in the form of an S-shaped structure. See the FIGURE.

Sheet 1 may be considered as including a series of three substrate areas A, B and C. Each of these substrate areas are substantially parallel to one another. By the nature of the S-shaped construction, at least one edge of each substrate area is unitarily joined with an edge of an adjacent parallel area. Although less desirable, the invention also envisages an S-shaped structure of unequal sized segments. For instance, substrate area A may be less than that of substrate area B and C.

A detergent composition 2 is deposited in a region between substrate areas A and B. This detergent composition 2 must be sufficiently tacky to also function as an adhesive holding together areas A and B of the folded substrate sheet. Detergent composition need not be but preferably is spread over substantially the full region between areas A and B. Under circumstances where the sheet is of rectangular geometry, the resultant folded construction with sandwiched detergent composition will, along the three resultant non-folded borders of the article, be of open construction permitting water to leach out the detergent composition. There will be no thermal or other bonding, except that supplied by the adhesivity of the composition itself, between the folded-over flaps of the sheet.

Sheet geometries other than that of rectangular or square are considered as possible geometries for purposes of this invention. Thus, irregular shapes may be employed including those having some rounded outer edges. For instance, the sheet may be in the shape of a bear or other animal, a face, a letter, a number or a company logo.

A further composition 3 for cleaning fabrics is spread in a region between the second and third substrate areas B and C. This further composition may be identical with detergent composition 1. Advantageously, however, the further composition may contain a component that is incompatible with one or more components of detergent composition 2. For instance, the further composition 3 may include a bleach such as sodium perborate, 1,12-diperoxydodecanedioic acid, or sodium dichloroisocyanurate. On the other hand, the detergent composition 2 may include an enzyme, surfactant and/or perfume which may readily be oxidized. By providing separate compositions in separate regions, components in one composition will be prevented from adversely interacting (e.g. oxidation) with those of the second composition.

SUBSTRATE

Substrates employed herein are water-insoluble and are solid or substantially solid materials. They can be dense or open in structure. Examples of suitable materials which can be used as a substrate include foam, foil, sponge, paper, woven or non-woven cloth. Absorbent capacity, thickness or fiber density are not limitations on the substrates which can be used herein, so long as the substrates exhibit sufficient wet-strength to maintain structural integrity through the complete washing cycles in which they are used.

Paper substrates which can be employed herein encompass the broad spectrum of known paper structures and are not limited to any specific papermaking fiber or wood pulp. Thus, the fibers derived from soft woods, hard woods, or annual plants (e.g., bagasse, cereal straw, and the like), and wood pulps, such as bleached or unbleached kraft, sulfite, soda ground wood, or mixtures thereof, can be used. Moreover, the paper substrates which can be employed herein are not limited to specific types of paper, as long as the paper exhibits the necessary wet-strength and thermal stability.

Each substrate may be formed of a number of plies. For instance, a paper substrate may be constructed of a 2 or more ply paper.

Preferred non-woven cloth substrates used in the invention herein can generally be defined as adhesively bonded fiberous products, having a web or corded fiber structure or comprising fiberous mats, in which the fibers are distributed haphazardly or in a random array or substantially aligned. Natural fibers may be utilized including wool, silk, jute, hemp, cotton, linen, sisal or ramie. Synthetic fibers are also suitable and may include rayon, cellulose ester, polyvinyl derivatives, polyolefins, polyamides, or polyesters. Any diameter or denier of the fiber, generally up to about 10 denier, can be used in the present invention.

DETERGENT COMPOSITION

Advantageously, the detergent composition should be sufficiently tacky to function adhesively in holding the surrounding two substrate layers. Thus, the composition requires a Tackiness Index of at least about 100, preferably at least about 200, and optimally at least about 300.

The weight ratio of detergent composition to the total weight of the two surrounding substrate layers will range from about 20:1 to 1:20, preferably about 10:1 to 1:10, optimally between about 8:1 to 1:8.

Present within the detergent composition are surfactant actives, which are normally at least semi-liquids, and other components which are normally solids. Advantageously, the Active Ratio should range from about 10:1 to about 1:10, preferably from about 4:1 to 1:4, and optimally from about 2:1 to 1:2. Active Ratio is defined as the weight of total surfactant actives divided by weight of total solids less actives.

Surfactant actives will be present in the detergent composition in an amount ranging from about 1 to about 50% by weight, preferably from about 10 to 30%, more preferably from about 15 to 25%. These surface active materials may be anionic, nonionic, zwitterionic, amphoteric, cationic or mixtures thereof.

Among the anionic surfactants are water-soluble salts of alkylbenzene sulfonates, alkyl sulfates, alkyl ether sulfates, paraffin sulfonates, α-olefin sulfonates, α-sulfocarboxylates and their esters, dialkyl sulfosuccinates, alkyl glycerol ether sulfonates, fatty acid monoglyceride sulfates and sulfonates, alkyl phenol polyethoxy ether sulfates, 2-acyloxy-alkane-1-sulfonates and α-alkoxyalkane sulfonates. Soaps are also useful as anionic surfactants.

Nonionic surfactants are water-soluble compounds produced, for instance, by the condensation of ethylene oxide with a hydrophobic compound such as an alkanol, alkyl phenol, polypropoxy glycol or polypropoxy ethylene diamine. Alcohol ethoxylates of carbon chain length 8 to 16 with an average ethylene oxide content of from 3 to 13 moles are particularly good actives.

Cationic surfactants include the quaternary ammonium compounds that have 1 or 2 hydrophobic groups with 8–20 carbon atoms; illustrative are cetyl trimethylammonium chloride and dioctadecyl dimethylammonium chloride. Cationics are known in the art to have increased oily soil removal and to be capable of fabric softening and conditioning.

Since this is only a partial list of the many possible surfactants, further candidates can be found in "Surface Active Agents and Detergents", by Schwartz, Perry and Berch (Interscience), the disclosure of which is herein incorporated by reference.

Detergent builders can be incorporated into the detergent composition to enhance the performance of the surfactants. Useful builders can include any of the conventional inorganic or organic builder salts. Typical of the well known inorganic builders are the sodium and potassium salts of the following: pyrophosphate, orthophosphate, tripolyphosphate, carbonate, bicarbonate, silicate, sesquicarbonate, borate and aluminosilicate.

Among the organic detergent builders that can be used in the present invention are the sodium and potassium salts of the following: citrate, amino polycarboxylate, nitrilotriacetates, polyacetal carboxylates, N-(2-hydroxyethyl)-nitrilodiacetates, ethylene diamine tetraacetates, hydroxyethylenediamine tetraacetates, diethylenetriamino pentaacetates, dihydroxyethyl glycine, phytates, polyphosphonates, oxydisuccinates, oxydiacetates, carboxymethyloxysuccinates, polyacrylates, acrylic/maleic acid copolymers, hydrofuran tetracarboxylates, ester linked carboxylate derivatives of polysaccharides such as the sodium and potassium starch maleates, cellulose phthalates, glycogen succinates, semi-cellulose diglycolates, starch and oxidized heteropolymeric polysaccharides.

Organic or inorganic builders as aforedescribed will normally be employed in amounts from 1 to 80%, preferably from 10 to 60%, optimally between 35 and 45%. Where the surface active co-component is calcium insensitive, builder will be unnecessary.

Particularly preferred builders are sodium polyacrylate of molecular weight 1,000–60,000 sold as Acrysol® by Rohm & Haas, and acrylic/maleic acid copolymer (preferred ratio about 2:1) of molecular weight 50,000–150,000 sold as Sokalan CP® by the BASF Corporation. These preferred builders may be incorporated at a concentration from about 0.5 to 10%, preferably from 1 to 8%, optimally about 5%. The foregoing is meant to illustrate but not limit the types of builders that can be employed in the present invention.

In addition to surfactants and builders, a number of minor additives commonly found in detergent compositions can be included. Examples of these additives include fillers, optical brighteners, perfumes, antiredeposition agents, pH buffers, colorants, foam suppressants and the like.

The further composition 3 may be identical to that of composition 2. In a preferred embodiment, however, this further composition will contain components distinct and, frequently incompatible, with that of the components in composition 2. Illustrative components in the further composition include bleaches, bleach precursors, enzymes, fabric softeners and mixtures thereof.

Among the bleaches, there may be included those of the peroxygen and chlorine variety. Examples of the peroxygen variety are sodium perborate monohydrate and tetrahydrate, sodium percarbonate, and potassium monopersulfate. Organic peroxy acids may also be employed including 1,12-diperoxydodecanedioic acid and peroxy succinic acid. Often the inorganic peroxygen compounds such as sodium perborate require an activator or precursor to stimulate production of active oxygen in the wash solution under washing temperatures. Representative bleach precursors include tetraacetyl ethylenediamine, sodium benzoyloxybenzene sulfonate, sodium nonoyloxybenzene sulfonate and 2-(N,N,N-trialkylammonium)alkyl sulfophenyl carbonate salts. Inorganic transition metal compounds such as manganese (II) or (III) salts or complexes may also be employed.

Among suitable enzymes for the further composition 3, there may be included proteases, amylases, lipases, cellulases and mixtures thereof.

Fabric softeners are another category of fabric treating agents that may be included in the further composition 3. Most suitable are quaternary ammonium salts which preferably are selected from imidazolinium and di-fatty alkyl di-lower alkyl ammonium salts. Most preferable is ditallow dimethyl ammonium methosulfate or chloride. Within the fabric softener composition there desirably is also included a distributing agent such as a polyalkoxylated derivative of sorbitan, fatty acid or fatty alcohol. Particularly preferred is polyethylene glycol monostearate.

MANUFACTURE

In one embodiment of the present invention, the laminated laundry article is prepared by taking a piece of substrate having triple the width of the final size, and applying a detergent composition slurry or paste 2 to a middle one-third of the substrate. An outer one-third of the substrate is then folded over to coincide and adhere to the coated middle one-third surface. Thereupon, an additional amount of slurry composition 2 or 3 is coated onto the backside of the middle one-third previously coated. The final one-third outer area of the substrate is then folded to coincide and join with the last to be coated middle surface. This procedure completely entraps the slurry or paste between the respective areas of the substrate. Substrate is then pressed with sufficient pressure to allow the slurry to bond to the respective substrate areas. Drying of the resultant cleaning article will normally be unnecessary because of the low water content, normally less than 30% based on the composition.

During a fabrics wash cycle the detergent composition redissolves and the laminate opens up to its original width achieving thereby complete composition release. This laminate construction has the advantage that it can contain at least twice as much of a detergent composition than a single sheet impregnate construction of equal physical dimensions. Since the slurry is contained between the three layers of substrate, the outside surface on both sides of the laminate is clean and slurry free thereby making the product pleasing to the touch. Any residual moisture or tackiness in the slurry is trapped between the layers and bonds the three layers together making it impossible for the laminate to come apart. Because the slurry is entrapped between the three layers of substrate, formulation constraints that exist with the single sheet impregnate construction no longer exist with the laminate construction. Normally undesirable and unavoidable sticky detergent compositions are thus now advantageous with laminate construction.

The following examples will more fully illustrate the embodiments of this invention. All parts, percentages and proportions referred to herein and in the appended claims are by weight unless otherwise stated.

EXAMPLE 1

A sheet (26 cm width by 60 cm length) of Hovolin 7354®, a non-woven rayon/polyester cloth, is used as the substrate. Hovolin 7354® has a weight of 120 g/M$^2$, thickness of 2.0 mm and a Frazier air porosity of 478 CFM/ft$^2$. The middle one-third the area of this substrate is coated with formula I outlined in the following table. A total of 103.6 grams formula I is delivered to the substrate. Thereafter, one of the outer one-third uncoated areas of Hovolin 7354® is folded over on top of the spread detergent formula.

A fabric conditioning formula II is then spread on the backside of the substrate area covered by the detergent formula I. The final one-third outermost substrate area is then folded back onto the fabric conditioning formula II coating. This resultant article is then fed through a pressing roller apparatus to ensure adhesivity between each of the formulas and the respective surrounding substrate areas.

Formula I

| Component | Weight % |
|---|---|
| Sodium Tripolyphosphate | 28.63 |
| Alkyl Polyglycoside (APG 500 cs) | 19.10 |
| Neodol 45-LST ® | 8.60 |
| Pluronic 25R8 ® | 4.80 |
| Sokalan CP-7 ® (acrylate:maleate) | 4.80 |
| Sodium Carbonate | 2.90 |
| Fluorescer | 0.30 |
| Perfume | 0.10 |
| Colorant | 0.02 |
| Water | 30.80 |
| Total | 100.00 |

Formula II

| Component | Weight (%) |
|---|---|
| Ditallowdimethyl Ammonium methyl sulfate | 95.1 |
| Stearyl Alcohol | 1.8 |
| Perfume | 3.0 |
| Fluorescer | 0.1 |
| Total | 100.0 |

EXAMPLE 2

An article again using Hovolin 7354® is provided using the same coating technique as reported in Example 1. Here the detergent composition is that outlined in formula III below. In place of the fabric conditioning composition, there is substituted a bleaching formula IV.

Formula III

| Component | Weight % |
|---|---|
| Sodium Linear Alkylbenzene Sulfonate | 15.59 |
| Neodol 25-9 ® | 5.20 |
| Acrysol ® (sodium polyacrylate) | 5.20 |
| Sodium Carbonate | 8.31 |
| Sodium Sulfate | 31.12 |
| Fluorescer | 0.37 |
| Perfume | 0.34 |
| Colorant | 0.17 |
| Water | 33.66 |
| Total | 100.00 |

Formula IV

| Component | Weight % |
|---|---|
| Sodium Sulfate | 25.20 |
| Diperoxydodecanedioic Acid | 9.25 |
| Sokalan CP-7 ® | 24.54 |
| Water | 35.46 |
| Total | 100.00 |

EXAMPLE 3

An article again using Hovolin 7354® is provided using the same coating technique as reported in Example 1. Here both the first and second formulas are the identical detergent composition which is outlined in formula V below.

Formula V

| Component | Weight % |
|---|---|
| Alfonic 1214-60 ® ($C_{12}$–$C_{14}$ alcohol ethoxylate) | 20.77 |
| Sodium Carbonate | 18.00 |
| Sodium Sulfate | 13.85 |
| Neodol 45-LST ® | 8.31 |
| Alkyl Sulfate | 6.92 |
| Sokolan CP-7 ® | 6.92 |
| Fluorescer | 0.50 |
| Perfume | 0.28 |
| Colorant | 0.22 |
| Water | 24.23 |
| Total | 100.00 |

EXAMPLE 4

A number of detergent compositions were prepared to evaluate their Tackiness Index. These compositions are outlined in Table I.

TABLE I

| Component | Sample No. 1 | 2 | 3 | 4 | 5 | 6 | 7 | 8 | 9 | 10 | 11 |
|---|---|---|---|---|---|---|---|---|---|---|---|
| Alkyl Polyglycoside (APG 500 ®) | 15.9 | 15.9 | 0.0 | 15.9 | 0.0 | 0.0 | 0.0 | 15.9 | 15.9 | 15.9 | 15.9 |
| Alkyl Polyglycoside (APG 550 ®) | 0.0 | 0.0 | 15.9 | 0.0 | 0.0 | 0.0 | 0.0 | 0.0 | 0.0 | 0.0 | 0.0 |
| Neodol 45-13 ® | 0.0 | 0.0 | 0.0 | 5.2 | 0.0 | 0.0 | 0.0 | 0.0 | 0.0 | 0.0 | 0.0 |
| Neodol 25-9 ® | 5.2 | 5.2 | 5.2 | 0.0 | 5.2 | 0.0 | 5.2 | 0.0 | 5.2 | 5.2 | 5.2 |
| Sodium $C_{11}$ Linear Alkylbenzene Sulfonate | 0.0 | 0.0 | 0.0 | 0.0 | 15.9 | 15.9 | 15.9 | 0.0 | 0.0 | 0.0 | 0.0 |
| Pluronic 25R8 ® | 0.0 | 0.0 | 0.0 | 0.0 | 0.0 | 0.0 | 0.0 | 5.2 | 0.0 | 0.0 | 0.0 |
| Sodium Lauryl Sulfate | 0.0 | 0.0 | 0.0 | 0.0 | 0.0 | 5.2 | 0.0 | 0.0 | 0.0 | 0.0 | 0.0 |
| Sodium Tripolyphosphate | 31.1 | 0.0 | 31.1 | 31.1 | 31.1 | 0.0 | 0.0 | 0.0 | 0.0 | 31.1 | 31.1 |
| Sodium Carbonate | 8.3 | 8.3 | 8.3 | 8.3 | 8.3 | 8.3 | 8.3 | 8.3 | 8.3 | 8.3 | 8.3 |
| Sodium Sulfate | 0.0 | 31.1 | 0.0 | 0.0 | 0.0 | 31.1 | 31.1 | 31.1 | 0.0 | 5.2 | 0.0 |
| Sodium Chloride | 0.0 | 0.0 | 0.0 | 0.0 | 0.0 | 0.0 | 0.0 | 0.0 | 31.1 | 0.0 | 0.0 |
| Sokalan CP-7 ® | 5.2 | 5.2 | 5.2 | 5.2 | 5.2 | 5.2 | 5.2 | 5.2 | 5.2 | 0.0 | 0.0 |
| Arysol-A1N ® | 0.0 | 0.0 | 0.0 | 0.0 | 0.0 | 0.0 | 0.0 | 0.0 | 0.0 | 5.2 | 0.0 |
| Water | 33.7 | 33.7 | 33.7 | 33.7 | 33.7 | 33.7 | 33.7 | 33.7 | 33.7 | 33.7 | 33.7 |
| TOTAL | | | | | | 100.0 | | | | | |

Each of the formulations in Table I was measured for its cohesive strength in terms of a Tackiness Index to determine suitability for use in the laminate construction of the present invention.

TACKINESS INDEX TEST

The apparatus consists of a round 1 13/16-inch diameter brass base plate mounted with a perforated sleeve serving as the sample holder. A similarly sized flat metal disk held by a hook is suspended above the perforated disk. The hook is attached to a Chatillon spring gauge actuated by a mechanized worm gear. The worm gear is moved upwards by a Boone KYC-22RC motor. The spring gauge (in grams) measures the force required to separate the disk from the sample.

Cohesion tests are conducted as follows. The temperature of the sample and effective parts of the apparatus are adjusted to 70°-80° F. They must remain within this temperature range while the test is being conducted.

The perforated sleeve of the base is raised and turned so that it remains elevated, resting on the small pin of the brass base plate. Approximately 15 grams of test sample is placed into a cup area that is formed when the perforated sleeve is in the raised position. To fill the cup, sample is charged to the center and then worked toward the edge in a spiral design. The disk is then pressed evenly and firmly onto the sample, forcing excess through the holes in the sleeve. Sample thickness is determined by the height of three screw heads that are attached onto the disk. Next, the sleeve is turned around until it slips down and the pin of the base plate fits into the slot on the sleeve.

A hook at the bottom end of the spring gauge mechanism engages a ring at the top of the disk. No pull on the sample is exerted initially. The scale indicator is adjusted to read 0. Then, the motor is started and allowed to run until the sample separates. At that point the scale is read again. This reading is the Tackiness Index value, expressed in grams.

Calibration of the scale before and after a run is done with a 125 gram known weight. Adjustments are made to the spring gauge when necessary.

TABLE II

| Sample | Tackiness Index (T) of Samples 1-11 T-1(g) | T-2(g) | Days Aged |
|---|---|---|---|
| 1 | 435 | >485 | 6 |
| 2 | 120 | 215 | 9 |
| 3 | >490 | >490 | 6 |
| 4 | 440 | >490 | 6 |

TABLE II-continued

| Sample | Tackiness Index (T) of Samples 1-11 T-1(g) | T-2(g) | Days Aged |
|---|---|---|---|
| 5 | >485 | >485 | 8 |
| 6 | 275 | >485 | 6 |
| 7 | >485 | >485 | 9 |
| 8 | 140 | 100 | 7 |
| 9 | 270 | >485 | 6 |
| 10 | 315 | 315 | 8 |
| 11 | >490 | >490 | 6 |

Results of the cohesion tests on samples 1-11 are recorded in Table II. T-1 represents Tackiness Index in grams of the detergent compositions directly after preparation. T-2 represents the Tackiness Index of the composition after 5 days of aging.

All the samples were prepared by mixing the formulation for 0.5 hours in a high shear mixer after addition of all components. The T-1 value was taken immediately upon completion of the mixing. For the aging study, the samples were stored for at least 6 days, subsequently mixed for one-half hour at high shear, and then tested for cohesive strength.

From Table II, it is evident that some of the formulations change in their cohesive properties as a function of time. Certain of the formulations are unacceptable upon preparation but with aging, the cohesive properties improve to come within the acceptable range.

EXAMPLE 5

In addition to the Tackiness Index, the detergent compositions have been evaluated for their adhesive properties through an Acceptability Rating Test. This test involves preparation of a laminate having a coating weight of 110 g per linear foot. All evaluations are carried out at ambient conditions 22°-25° C. and relative humidity averaged about 60%.

The particular substrate being used in the evaluation is cut to the appropriate size and a specified amount of the detergent compositions placed on one-half the substrate. Thereafter, the uncoated half is folded onto the coated half. These are pressed together until the detergent composition just begins to extrude from the sides of the laminate. The laminate is then pulled apart starting at the corner so as to physically separate the two halves. The force necessary to perform this separation is compared to that of a standard formulation. Ratings are assigned in conformance with that of the list under Table III.

TABLE III

| Index | Acceptability Rating Meaning |
|---|---|
| 4 | Very difficult to pull apart |
| 3 | Easier to pull apart but maintains acceptable adhesion |
| 2 | Very easy to pull apart (Unacceptable) |
| 1 | No adhesion |

Results of several evaluations covering various detergent compositions and substrate types are provided in Table IV.

TABLE IV

| Substrate | Porosity CFM/ft$^2$ | Substrate Thickness (mm) | Substrate Base Weight g/M$^2$ | Sample No. | WR* | Tackiness Index | Acceptability Rating Index |
|---|---|---|---|---|---|---|---|
| HV 712B | 94 | 0.508 | 106.7 | 2 | 0.74 | 215 | 2 |
| HV 712B | 94 | 0.508 | 106.7 | 2 | 3.61 | 215 | 2 |
| HV 712B | 94 | 0.508 | 106.7 | 2 | 18.00 | 215 | 3 |
| HV 7301 | 180 | 0.889 | 124.8 | 2 | 15.20 | 215 | 3 |
| HV 7301 | 180 | 0.889 | 124.8 | 2 | 27.50 | 215 | 2 |
| HV 7395 | 237 | 1.240 | 136.1 | 2 | 2.58 | 215 | 2 |
| HV 7395 | 237 | 1.240 | 136.1 | 2 | 6.45 | 215 | 3 |
| HV 7395 | 237 | 1.240 | 136.1 | 2 | 17.30 | 215 | 3 |
| HV 7333 | 550 | 2.290 | 90.4 | 2 | 2.97 | 215 | 2 |
| HV 7333 | 550 | 2.290 | 90.4 | 2 | 9.64 | 215 | 2 |
| HV 7333 | 550 | 2.290 | 90.4 | 2 | 25.30 | 215 | 3 |
| HV 712B | 94 | 0.508 | 106.7 | 8 | 4.40 | 100 | 2 |
| HV 712B | 94 | 0.508 | 106.7 | 8 | 7.75 | 100 | 2 |
| HV 712B | 94 | 0.508 | 106.7 | 8 | 15.20 | 100 | 3 |
| HV 7301 | 180 | 0.889 | 124.8 | 8 | 9.28 | 100 | 2 |
| HV 7301 | 180 | 0.889 | 124.8 | 8 | 13.60 | 100 | 3 |
| HV 7301 | 180 | 0.889 | 124.8 | 8 | 20.80 | 100 | 3 |
| HV 7395 | 237 | 1.240 | 136.1 | 8 | 3.02 | 100 | 2 |
| HV 7395 | 237 | 1.240 | 136.1 | 8 | 6.85 | 100 | 3 |
| HV 7395 | 237 | 1.240 | 136.1 | 8 | 21.50 | 100 | 3 |
| HV 7333 | 550 | 2.290 | 90.4 | 8 | 4.11 | 100 | 2 |
| HV 7333 | 550 | 2.290 | 90.4 | 8 | 10.30 | 100 | 2 |
| HV 7333 | 550 | 2.290 | 90.4 | 8 | 24.10 | 100 | 3 |
| HV 712B | 94 | 0.508 | 106.7 | 10 | 4.87 | 315 | 3 |
| HV 712B | 94 | 0.508 | 106.7 | 10 | 8.45 | 315 | 4 |
| HV 712B | 94 | 0.508 | 106.7 | 10 | 18.80 | 315 | 4 |
| HV 7301 | 180 | 0.889 | 124.8 | 10 | 16.00 | 315 | 4 |
| HV 7301 | 180 | 0.889 | 124.8 | 10 | 23.40 | 315 | 4 |
| HV 7395 | 237 | 1.240 | 136.1 | 10 | 4.63 | 315 | 3 |
| HV 7395 | 237 | 1.240 | 136.1 | 10 | 6.26 | 315 | 4 |
| HV 7395 | 237 | 1.240 | 136.1 | 10 | 23.20 | 315 | 4 |
| HV 7333 | 550 | 2.290 | 90.4 | 10 | 5.00 | 315 | 3 |
| HV 7333 | 550 | 2.290 | 90.4 | 10 | 9.29 | 315 | 3 |
| HV 7333 | 550 | 2.290 | 90.4 | 10 | 25.70 | 315 | 4 |

*WR = Weight of Coating/Weight of Substrate

The Acceptability Rating Index is seen to be a function of several variables including that of the tackiness index, coating weight ratio (WR), and the porosity of the substrate. Generally, there is required a higher value of WR as the porosity of the substrate increases. The Tackiness Index is the most important variable that affects the acceptability of the article. Those compositions with the highest Acceptability Rating Index correlate with those having the highest Tackiness Index.

It has been found that varying the total actives to solid ratio at constant moisture has an affect upon the Tackiness Index. Table V summarizes results for two detergent compositions, samples 1 and 5. Sample 1 incorporates a mixed nonionic active system while sample 5 incorporates combined anionic/nonionic active system.

TABLE V

| Tackiness Index as Function of Active Level | | |
|---|---|---|
| Sample | Active Ratio* | Tackiness Index |
| 1 | 1:2 | 435 |

TABLE V-continued

| Tackiness Index as Function of Active Level | | |
|---|---|---|
| Sample | Active Ratio* | Tackiness Index |
| 1 | 2:1 | 120 |
| 1 | 1:4 | 485 |
| 1 | 4:1 | 30 |
| 5 | 1:1 | >485 |
| 5 | 2:1 | >485 |
| 5 | 1:4 | 405 |
| 5 | 4:1 | >485 |

*Active Ratio = Weight Total Actives/(Total Solids - Total Actives)

The foregoing description and Examples illustrate selected embodiments of the present invention. In light thereof, various modifications will be suggested to one skilled in the art, all of which are within the spirit and purview of the invention.

What is claimed is:

1. An article for delivering a cleaning composition to a wash water comprising;

(i) a flexible substrate folded into a unitary S-shaped construction, said construction including three substrate areas each lying in substantially parallel planes one above another;

(ii) a detergent composition comprising an effective amount for cleaning fabrics of a surfactant and a builder, said composition being spread in a region between a first and second of said substrate areas and having an adhesive strength sufficient to bind said first and second areas together, and at least one edge length of said first area not being bonded, other than through said detergent composition, to an adjacent edge length of said second area thereby allowing egress of said composition into said wash water, and said substrate separating into but a single sheet upon exhaustion of detergent composition therefrom; and (iii) a further composition for cleaning fabrics which is spread in a region between said second area and a third adjacent one of said substrate areas and having an adhesive strength sufficient to bind said second and third area together, and at least one edge length of said second area not being bonded, other than through said further composition, to an adjacent edge length of said third area and thereby allowing egress of said further composition into said wash water, said further composition comprising a component selected from the group consisting of bleaches, bleach precursors, enzymes, fabric softeners and mixtures thereof.

2. An article according to claim 1 wherein said detergent comprises a surfactant selected from the group consisting of nonionic, anionic, cationic, zwitterionic, amphoteric surfactants and mixtures thereof.

3. An article according to claim 1 wherein the weight ratio of detergent composition to the total folded substrate ranges from 20:1 to 1:20.

4. An article according to claim 1 wherein the weight ratio of detergent composition to the total folded substrate ranges from 8:1 to 1:8.

5. An article according to claim 1 wherein said substrate is formed from a natural or synthetic fiber selected from the group consisting of paper, woven cloth and non-woven cloth.

6. An article according to claim 1 wherein said substrate is a non-woven material selected from the group consisting of rayon, polyester, polypropylene, polyethylene and mixtures thereof.

7. An article according to claim 1 wherein said builder is a polycarboxylate material selected from the group consisting of polyacrylate, acrylic/maleic acid derived copolymer, and mixtures thereof.

8. An article according to claim 1 wherein said further composition comprises a bleach.

9. An article according to claim 8 wherein said bleach is an inorganic peroxygen compound selected from the group consisting of sodium perborate monohydrate, sodium perborate tetrahydrate, sodium percarbonate and potassium monopersulfate.

10. An article according to claim 8 wherein said bleach is an organic peroxygen acid selected from the group consisting of 1,12-diperoxydodecanedioic acid and peroxy succinic acid.

11. An article according to claim 1 wherein the bleach precursor is selected from the group consisting of tetraacetyl ethylenediamine, sodium benzoyloxybenzene sulfonate, sodium nonoyloxybenzene sulfonate and 2-(N,N,N-trialkylammonium)alkyl sulfophenyl carbonate salt.

12. An article according to claim 1 wherein said enzyme is selected from the group consisting of proteases, amylases, lipases, cellulases and mixtures thereof.

13. An article according to claim 1 wherein said fabric softener is a quaternary ammonium salt.

14. An article according to claim 13 wherein said quaternary ammonium salt is a ditallowdimethyl ammonium salt.

15. An article for delivering a cleaning composition to a wash water comprising;

(i) a flexible substrate folded into a unitary S-shaped construction, said construction including three substrate areas each lying in substantially parallel planes one above another;

(ii) a detergent composition comprising an effective amount for cleaning fabrics of a surfactant and a builder, said composition being spread in a region between a first and second of said substrate areas and having an adhesive strength sufficient to bind said first and second areas together, and at least one edge length of said first area not being bonded, other than through said detergent composition, to an adjacent edge length of said second area thereby allowing egress of said composition into said wash water, and said substrate separating into but a single sheet upon exhaustion of detergent composition therefrom; and (iii) a further composition for cleaning fabrics which is spread in a region between said second area and a third adjacent one of said substrate areas and having an adhesive strength sufficient to bind said second and third area together, and at least one edge length of said second area not being bonded, other than through said further composition, to an adjacent edge length of said third area and thereby allowing egress of said further composition into said wash water, said further composition comprising a component selected from the group consisting of sodium perborate monohydrate, sodium perborate tetrahydrate, sodium percarbonate, sodium monopersulphate, 1,12-diperoxydodecanedioic acid, peroxysuccinic acid, sodium dichloroisocyanurate, tetraacetyl ethylenediamine, sodium benzoyloxybenzene sulfonate, sodium nonoyloxybenzene sulfonate and 2-(N,N,N-trialkylammonium)alkyl sulfophenyl carbonate salt.

* * * * *